US008276535B1

(12) United States Patent
Karem

(10) Patent No.: US 8,276,535 B1
(45) Date of Patent: Oct. 2, 2012

(54) SEABASING SHIP

(76) Inventor: Abe Karem, Tustin, CA (US)

( * ) Notice: Subject to any disclaimer, the term of this patent is extended or adjusted under 35 U.S.C. 154(b) by 586 days.

(21) Appl. No.: 12/186,829

(22) Filed: Aug. 6, 2008

Related U.S. Application Data

(60) Provisional application No. 60/954,136, filed on Aug. 6, 2007.

(51) Int. Cl.
*B63B 35/50* (2006.01)

(52) U.S. Cl. ..... 114/261

(58) Field of Classification Search ..... 114/65 R, 114/72, 77 R, 261, 264
See application file for complete search history.

(56) References Cited

U.S. PATENT DOCUMENTS

| | | | | |
|---|---|---|---|---|
| 3,572,611 | A | 3/1971 | Oulton | |
| 4,325,317 | A * | 4/1982 | Wilford | 114/261 |
| 4,529,152 | A * | 7/1985 | Bernard | 114/261 |
| 5,218,921 | A | 6/1993 | Malcolm et al. | |

OTHER PUBLICATIONS http://www.history.navy.mil/planes/ch53.htm, Nov. 15, 2000.*
LHD amphibious assault ship: Jane's Fighting Ships, 2004-2005, Jane's Information Group, Jul. 2004. p. 862.
Large, Medium-Speed Roll-On/Roll-Off Ship (LMRS): Jane's Fighting Ships, 2004-2005, Jane's Information Group, Jul. 2004. p. 881-882.
Proposed Mobile Offshore Base (MOB), using oil platforms as a basis; Taylor, R., and P. Palo, U.S. Mobile Offshore Base Technological Report, Proceedings of the 23rd UJNR Marine Facilities Panel Meeting, May 2000, Tokyo, Japan. (http://web.archive.org/web/20050224101358/http://www.dt.navy.mil/ip/mfp/paper30.html).
Wilson, J., Military Joint Mobile Offshore Base, Popular Mechanics, Apr. 2003 http://www.globalsecurity.org/military/systems/ship/images/mob-flex_b_full.jpg.
Proposed conversion of a Maersk S-Class containership into a seabasing ship; Naval Research Advisory Committee, Sea Basing, Presentation to The Honorable John J. Young, Jr., ASN (RD&A), Aug. 5, 2004, Slide 22 http://www.onr.navy.mil/nrac/docs/2005_brief_sea_basing.pdf.
Trimersible seabasing ship; Barnard, R. "The Trimersible Enters the Fray as Navy Refines its Sea Basing Concept", Sea Power, Jun. 2003.

* cited by examiner

*Primary Examiner* — Lars A Olson
(74) *Attorney, Agent, or Firm* — Fish & Associates, PC

(57) ABSTRACT

The density of "ready for take-off" aircraft on a flight deck of a ship is increased by orienting the aircraft at orientation angles between 20° and 180° from dead ahead. Preferred ships are modified from, or utilize a design derived from an existing ship, especially a large containership or other commercial ship. One or more payload staging decks can be advantageously located under the flight deck. All suitable types of aircraft are contemplated, including especially helicopters, tilt-rotors, and other rotorcraft. In preferred embodiments at least three, five, or ten aircraft are vertical take-off and landing (VTOL) aircraft. Also in preferred embodiments, at least five of the first plurality of the aircraft are capable of carrying a payload greater than 20,000 pounds.

9 Claims, 8 Drawing Sheets

SEABASING SHIP

This application claims priority to U.S. Provisional Application Ser. No. 60/954,136 filed Aug. 6, 2007 which is incorporated by reference herein in its entirety.

FIELD OF THE INVENTION

The field of the invention is warships, and in particular ships that carry aircraft. (Class114/1).

BACKGROUND OF THE INVENTION

There is a need for ships which can provide a seabasing capability; combining roles of transporting or housing aircraft, vehicles, and personnel. In existing naval fleets, these roles are usually separated, and ships that fulfill one or more of these roles are often of limited capacity and capability. Furthermore, prior art proposals for seabasing ships have been either very slow or had a very limited capacity for large transport aircraft.

Fixed-wing tactical aircraft operating from large aircraft carriers have been a key component of major surface navies for the last 65 years. Among the most prominent examples are the US Navy's nuclear aircraft carriers, CVN, as shown in FIG. 1. The flight deck 102 is constructed on top of a ship hull 104 and features catapults 106 aligned with the ship to facilitate aircraft launch, and arresting wires oriented across a landing area 108 of the flight deck for aircraft recovery Amphibious assault ships (such as the US Navy LHA and LHD, FIG. 2) provide marine units a seaborne platform for support of combat operations from the sea. Vertical takeoff aircraft 202 are positioned on the flight deck 204 of a LHD ship 200, takeoff marks 206 aligned with the ship indicate from where aircraft can launch. While such ships rely primarily on air-cushion landing craft to deploy heavy combat-ready vehicles, including armored vehicles, to a beachhead, they also provide facilities for helicopter transport of troops, light vehicles, and supplies.

The US military uses special roll-on roll-off (RO-RO) ships (FIG. 3) to pre-position heavy armored vehicles close to where they may be needed. Such a ship 300 includes provisions 302 for armored vehicles to drive onboard, and typically minimal helicopter landing provisions 304. The deployment of heavy legacy armor including Abrams battle tanks and Bradley armored troop carriers, heavy artillery, and engineer vehicles requires substantial port facilities in the area of operation to deploy on land.

Recently, the US Army has invested in the development of lighter-weight survivable armored vehicles, with program names of Interim Brigade and Future Combat System. This revamped Army plan would provide highly mobile units with vertical maneuver capabilities using a proposed Joint Heavy Lift aircraft to transport light armored vehicles, crews, and combat troops into battle and back at typical radii of deployment of 250 to 750 nautical miles. As used herein, Joint Heavy Lift (JHL) aircraft shall refer to aircraft and aircraft concepts capable of transporting armor or troops and capable of vertical takeoff. Especially preferred JHL aircraft include tilt-rotors with two rotors of 65, 75, 80, or even 90-foot diameter each and are capable of carrying payloads of 20,000, 40,000, 60,000, 80,000, or even 100,000 pounds.

Due to the possible lack of land bases near future battlefields, vehicles, troops, and JHL aircraft may be supported and deployed from large ships or mobile basing platforms, under the concept generally referred to as seabasing. Many prior art alternatives for providing a seabasing capability have been studied, and generally these fall into two principal categories.

The first category comprises very large structures based on oil platform technology, such as the prior art mobile offshore base (MOB, FIG. 4), sized for conventional takeoff of aircraft (up to 5,000 feet long and 500 feet wide). A MOB 400 has a runway 402 dimensioned for the requirements of conventional takeoff transport aircraft 404. The MOB concepts proposed have typically comprised three to five joinable sections, each section being transported separately, usually with the aid of tugboats. While the MOB Seabasing platform can carry and operate many aircraft, it is an almost stationary platform when assembled on station, with maximum speeds of approximately 5 knots, and a very high cost, estimated to be $8-10 billion in 2007.

The second category of prior art is based on adaptations of large ships of various types, including commercial containerships, a prior art example is shown in FIG. 5. A converted containership 500 has a hull 502 and is equipped with a flight deck 504 and aircraft 506 can launch or recover from takeoff and landing spots 508 aligned with the ship. The aircraft 506 pictured is a small Bell™ V-22 tilt-rotor having 38 foot diameter rotors. It is estimated that the ship 500 would have a capacity of only 4 to 5 large JHL aircraft having 75 foot diameter rotors. Prior art containership conversions have also left the original containership superstructure 510 largely intact, which prevents the on-deck transport of large aircraft between the bow and aft ends of the flight deck. While a short sponson 512 enlarges the breadth of the flight deck somewhat beyond that of the original containership beam, the enlarged portion extends for a length of only about 15-20% of the flight deck length.

Some other purpose-built concepts have also been proposed, as exemplified in FIG. 6, which is a seabasing ship 600 that is similar to a floating platform but is designed for faster travel, but still slow with a sustained speed of no more than 5-10 knots. This proposed ship 600 has a length of approximately 1180 feet, an overall breadth of about 650 feet, and an operating displacement of about 588,000 short tons. Unless the context dictates the contrary, all ranges set forth herein should be interpreted as being inclusive of their endpoints.

The present inventive material focuses on seabasing ships derived from container ships that offer sufficient speed (23-25 knots) to operate in company with existing ships (CVN aircraft carriers, destroyers, and cruisers). However, all previously proposed seabasing conversion concepts are arranged to carry very few JHL-scale aircraft, a limitation which prevents a high rate of aircraft sortie generation, which is vital for the combat deployment of armored or mechanized forces. Furthermore, previously proposed seabasing conversion concepts have featured flight decks which were only as wide as the containership beam. To increase the rate of aircraft sortie generation, it is further advantageous to have a large number of aircraft simultaneously ready for take-off.

As used herein, the term "ready for take-off" means that the aircraft can be launched into the air without substantially re-orienting, re-spotting, or re-configuring the aircraft. Examples of aircraft being ready for take-off include a jet on the catapult on an aircraft carrier, or a JHL aircraft or helicopter that is positioned at a takeoff position on a helicopter launching pad or on a flight deck. In FIG. 1, for example, none of the aircraft are "ready for takeoff" as defined herein because every one of them must be re-oriented or re-spotted onto a catapult. In FIG. 2, none of the aircraft are "ready for takeoff" as defined herein because in every one of them must be re-oriented or re-spotted to a takeoff spot with adequate clearance. The mobile offshore base of FIG. 4 has one aircraft 406 ready for takeoff on a conventional runway. FIG. 5 shows three tilt-rotors ready for takeoff, but they are all have orientation angles of zero consistent with other prior art. FIG. 6 shows multiple rotorcraft ready for takeoff, but the ship is really a modified oil platform, which is not configured to realistically exceed 15 knots.

The major reason for the limited number of JHL aircraft accommodated on the flight deck of currently proposed and prior art fast ships is the general assumption that aircraft must align into the wind, or most commonly toward the ship's bow, for launch and recovery operations. To the best knowledge of the Applicant, this is consistent with standard naval operating procedure. Conventional aircraft positioning also requires military vehicles, while being loaded into their assigned aircraft, to maneuver between the aircraft being loaded and the one directly behind it. This results in further required separation between aircraft and reduces the tempo of vehicle loading, to avoid an increased risk of damage to aircraft due to accidental contact.

The issue of the number of JHL aircraft on a fast seabasing ship becomes more critical in view of the currently preferred aircraft configuration for a fast, long-range and efficient JHL, a large wing-span tilt-rotor aircraft with two rotors of 75 foot diameter each.

Therefore, there remains a need for a fast ship (23-27 knots), with affordable cost ($500 million or less when fully equipped for military seabasing), which can carry and operate a large number of JHL aircraft of the preferred configuration, and facilitate a high rate of aircraft recovery, loading, and launch.

SUMMARY OF THE INVENTION

The present invention provides apparatus, systems, and methods in which the density of "ready for take-off" aircraft on a flight deck of a ship is increased by orienting the aircraft at orientation angles between 20° and 180° from dead ahead.

Contemplated ships include those that have a hull form and installed power that allows the ship to cruise with a speed of at least 20 knots, which speed is deemed to be important to keep up with a naval task force or other naval ships. Preferred ships are modified from, or utilize a design derived from an existing ship, especially a large containership or other commercial ship.

The flight deck can be any suitable size and shape, including especially flights decks having a maximum breadth of at least 170 feet, and more preferably at least 180, 200 feet. Larger maximum breadths are also contemplated, including at least 220, 240, or 260 feet. It is especially contemplated that the flight deck can be sized and dimensioned to accommodate a second plurality of the aircraft arranged on an opposite side of the flight deck and ready for take-off, with each of the second plurality of aircraft also having an orientation angle between 20° and 180° from dead ahead.

One or more payload staging decks can be advantageously located under the flight deck. The payload staging deck(s), or other decks, can store armored vehicles, ordnance, fuel, personnel, or other items that could be carried as cargo in the aircraft. Such cargo can be advantageously raised to the flight deck using one or more elevators, which are preferably central (inboard) relative to the flight deck. Still more preferably, at least some of the aircraft are placed about at least one of the elevators in a carousel fashion to facilitate on-loading and offloading. As used herein, arranging objects in a "carousel fashion" on a flight deck means placing and orienting at least some of the objects in a direction oblique to dead ahead. It is especially contemplated that the flight deck can have a centerline, and at least one of the elevators is located within 20% of a distance from the centerline to the nearer edge of the flight deck.

All suitable types of aircraft are contemplated, including especially helicopters, tilt-rotors, and other rotorcraft. In preferred embodiments at least three, five, or ten of the first plurality of the aircraft are vertical take-off and landing (VTOL) aircraft. Also in preferred embodiments, at least five of the first plurality of the aircraft are capable of carrying a payload greater than 20,000 pounds.

In another aspect, a ship capable of transporting containers of a collective volume of at least 2,000 twenty-foot equivalent units (TEUs) can be improved by adding a flight deck of average breadth at least 15% larger than the ship beam and of maximum length at least 60% of the ship maximum length. In still other embodiments, the ship can be improved by adding at least three elevators to the ship, each capable of servicing the flight deck and capable of transporting an armored vehicle of at least 20,000 pounds. In some cases the at least some of the propulsion system intake and/or exhaust system can be advantageously relocated or replaced to make better use of the available deck space for payloads or other cargo.

A more complete understanding of the present invention and the attendant features and advantages thereof may be had by reference to the following detailed description of the invention when considered in conjunction with the following drawings.

DETAILED DESCRIPTION OF THE INVENTION

Figure 1:
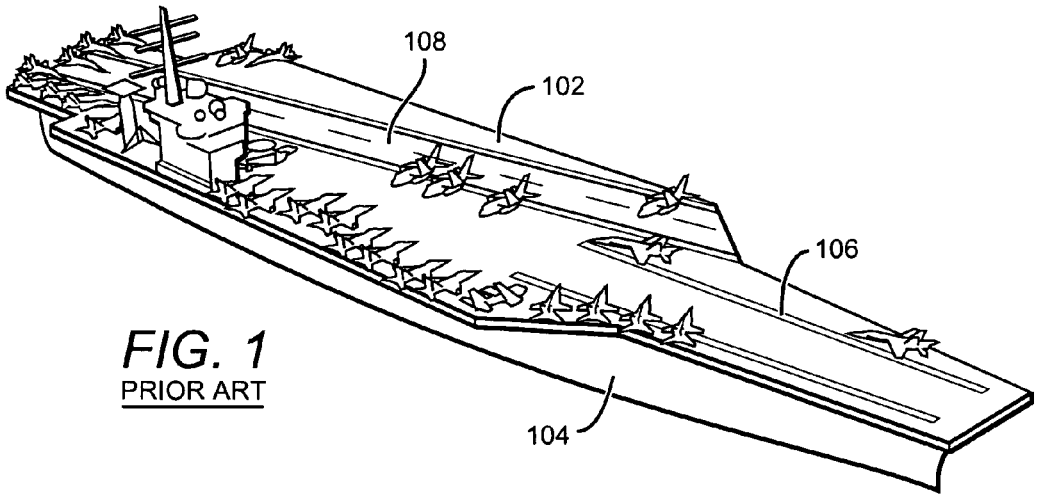
FIG. 1 PRIOR ART
FIG. 1 is a depiction of the prior art Nimitz-class aircraft carrier.
Figure 2:
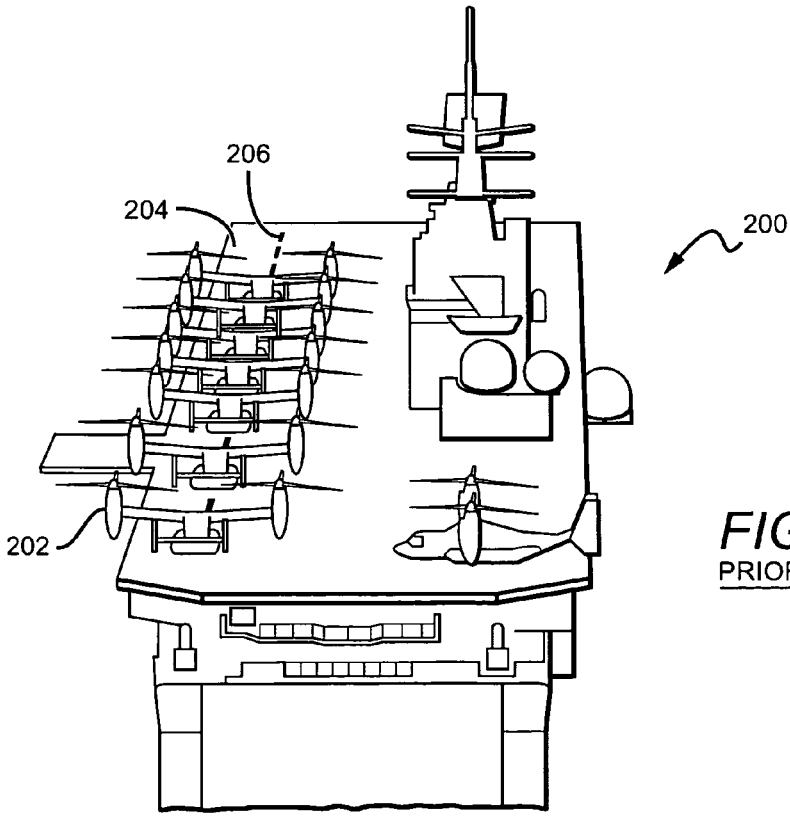
FIG. 2 PRIOR ART
FIG. 2 is a depiction of the prior art LHD amphibious assault ship.
Figure 3:
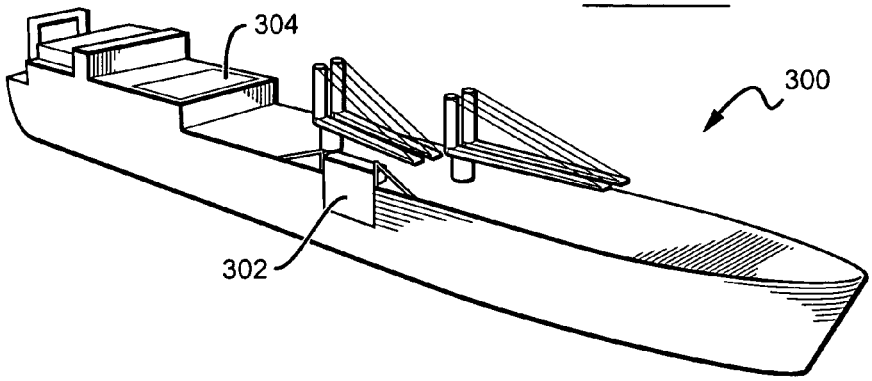
FIG. 3 PRIOR ART
FIG. 3 is a depiction of a prior art large, medium-speed roll-on/roll-off ship.
Figure 4:
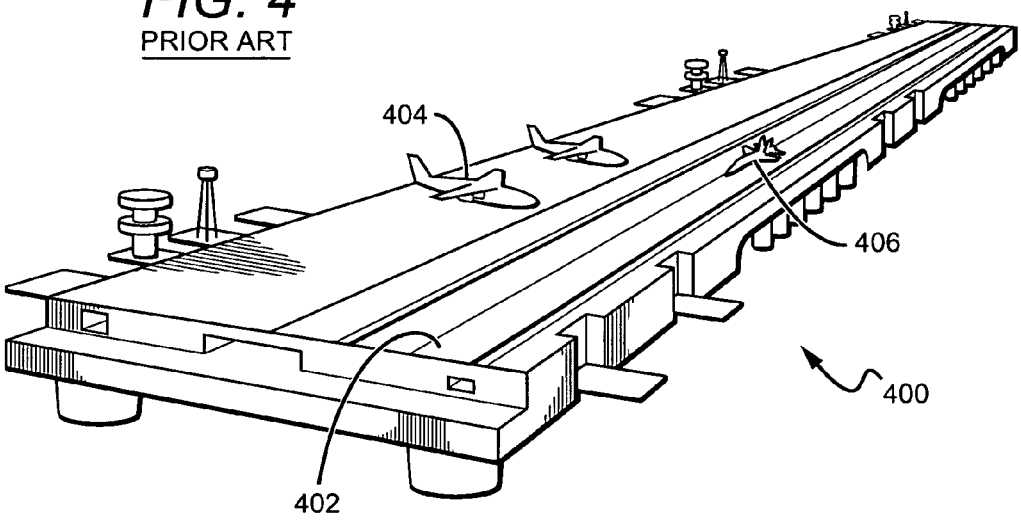
FIG. 4 PRIOR ART
FIG. 4 is a depiction of a prior art proposed mobile offshore base, using oil platforms as a basis.
Figure 5:
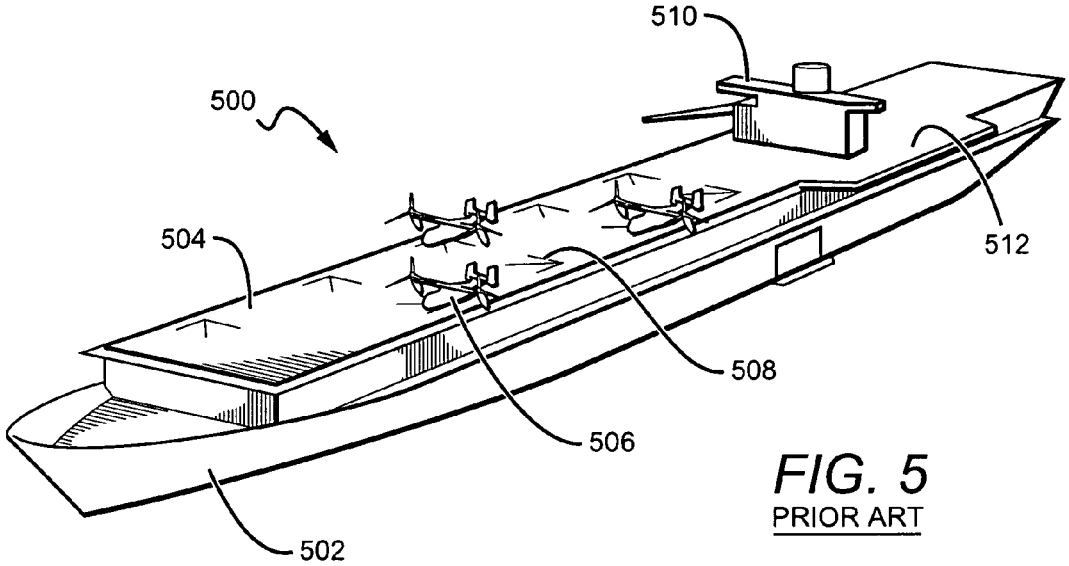
FIG. 5 PRIOR ART
FIG. 5 is a diagram of a prior art proposed conversion of a Maersk™ S-Class containership into a seabasing ship.
Figure 6:
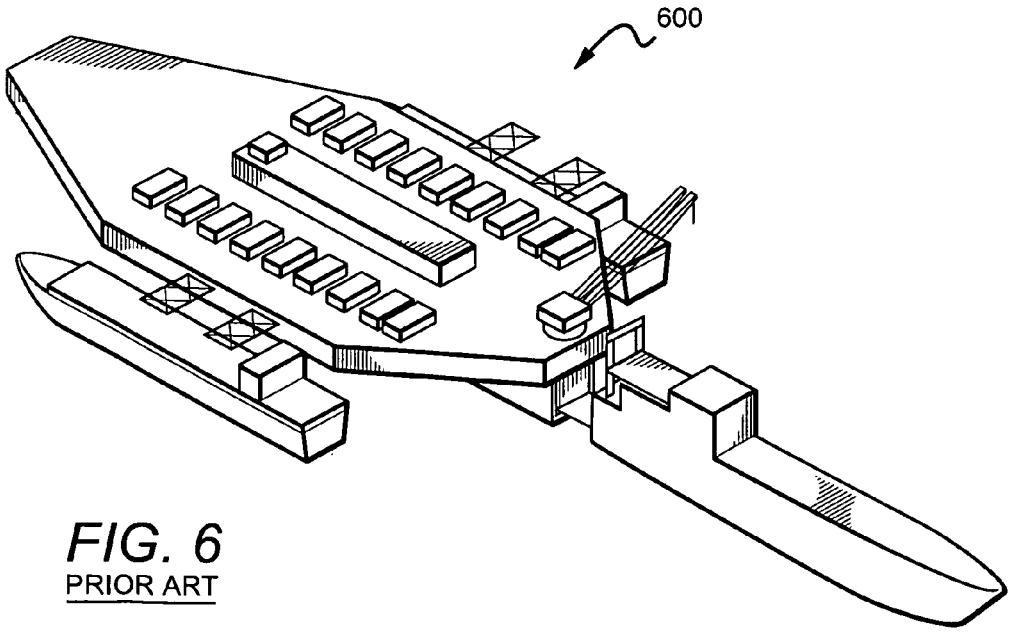
FIG. 6 PRIOR ART
FIG. 6 is a depiction of a prior art Trimersible™ seabasing ship.
Figure 7:
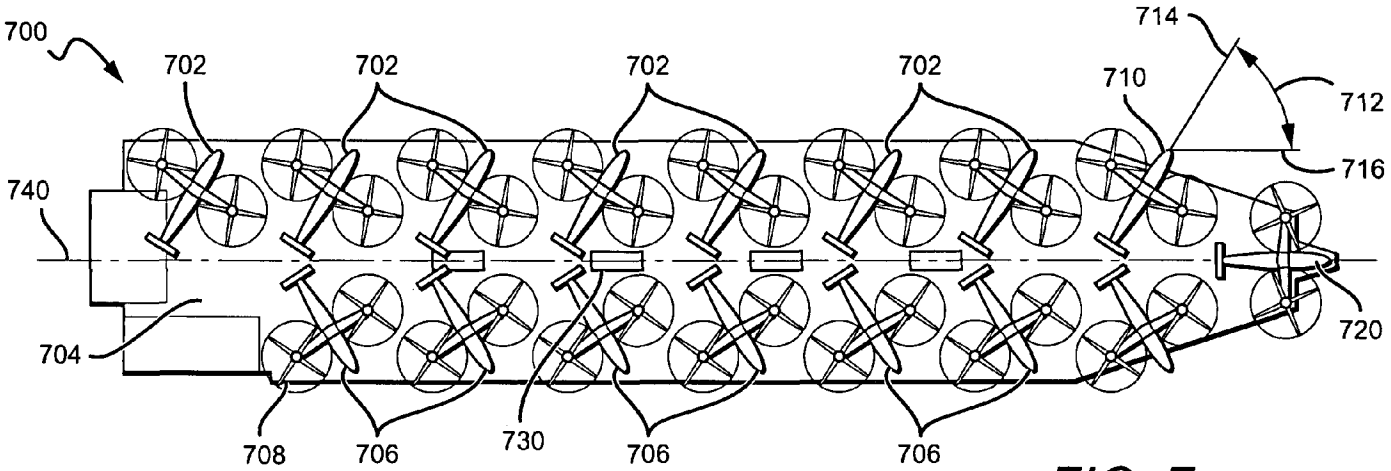
FIG. 7 is a top view of a preferred embodiment ship for seabasing with JHL aircraft on deck arranged in a carousel fashion.

The present invention provides apparatus, systems and methods in which aircraft are placed on the flight deck of a ship in a carousel configuration, where some or all of the aircraft are facing obliquely outboard on one or more sides of the ship. FIG. 7 is a top view of an especially preferred embodiment seabasing ship 700 with a first plurality of aircraft 702 arranged on the flight deck 704. A second plurality of aircraft 706 is placed along an opposite side 708 of the flight deck 704. An exemplary one of the aircraft 710 has an orientation angle 712 defined as the angle between an imaginary line 714 parallel with the dead ahead direction (along the ship) and another imaginary line 716 parallel with a long axis of the aircraft. Aircraft 720 is aligned dead ahead, in which case the orientation angle is defined to be zero.

The design provides for rapid and safe loading of vehicles into aircraft spotted for flight operations (that is, aircraft ready for takeoff without taxiing or re-spotting), with up to two to three times more rotorcraft on deck than is possible with conventional nose toward the bow orientation. To the best knowledge of the Applicant, operating a ship according to these principles would involve a change in standard naval operating procedures. The design permits a large number of aircraft to launch essentially simultaneously, or in rapid succession, a military capability which is highly important for delivering combat vehicles into the desired landing zone as compactly and rapidly as possible. To facilitate loading and unloading of vehicles on the flight deck, while leaving the maximum extent of deck edge free for aircraft spots, the vehicle and payload elevators 730 are placed along the centerline 740 of the ship.

An especially preferred seabasing ship 700 is converted from a Maersk™ Emma Maersk containership having a length of approximately 1,300 feet, and featuring a single-screw direct-drive diesel of approximately 108,000 horsepower which can propel the ship to a 25 knot cruise. The converted ship has a flight deck freeboard of about 76 feet, a waterline beam of 184 feet, and a flight deck breadth of 250 feet. This ship could accommodate operating spots for sixteen JHL aircraft with 75-foot diameter rotors, and would feature three internal decks for vehicle and cargo stowage plus a staging deck immediately below the flight deck. A stern elevator could accommodate three folded aircraft, and could connect to a hangar accommodating another three folded aircraft. The ship could also feature armor elevators, with four serving the flight deck, and eight additional elevators for moving cargo between stowage decks and the payload staging area. Additionally, the ship could have a side-port and RO/RO ramp on the starboard side.

The advantageous orientation of the aircraft obliquely (instead of nose toward the bow, or dead-ahead) will not negatively impact flight operations. Vertical takeoff and landing (VTOL) aircraft, especially rotorcraft, benefit from wind during VTOL operation due to the reduced required power for hover flight. Alternately, such aircraft can take off and land with more useful load (payload and/or fuel) with wind. However, the benefit is unrelated to the direction of the wind: during vertical take-off, a tail-wind or cross-wind are as beneficial as a head-wind. Therefore, regardless of the aircraft's desired maneuver after take-off, for the vertical take-off maneuver itself there is no advantage in directing the rotorcraft "into the wind" or in aligning the rotorcraft with its nose toward the bow of the ship (dead ahead). Additionally, recent advances in aircraft automatic flight control make it possible for rotorcraft to take off into a variety of wind conditions which would have previously been very difficult for human pilots to safely perform.

Figure 8:
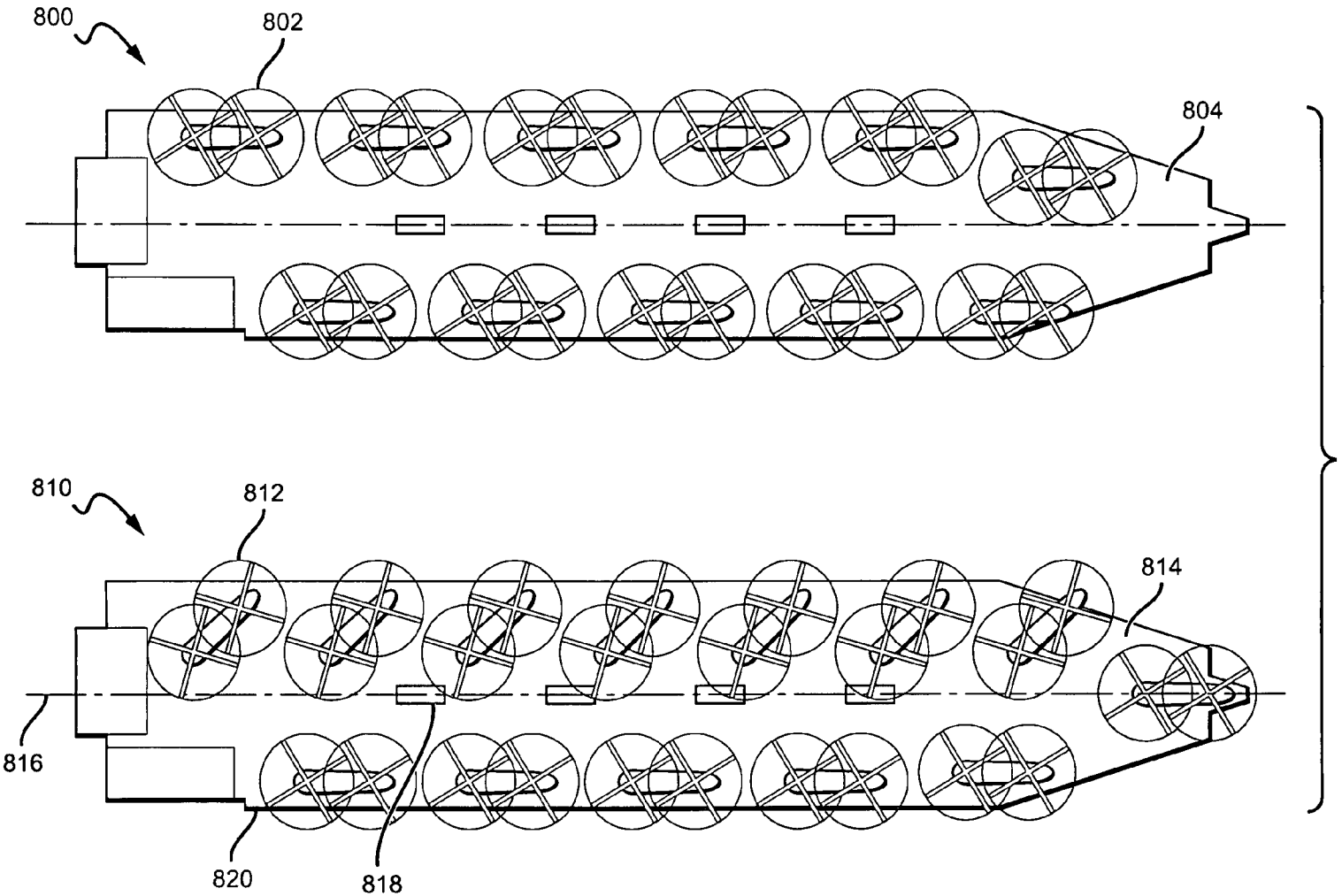
FIG. 8 is a set of top views of a ship having a flight deck. Aircraft can be arranged inline with the ship 800, or aircraft can be advantageously arranged in a carousel fashion 810.

The present inventive material has application and importance for high military utility of large JHL aircraft, especially tilt-rotor JHL aircraft; it is also beneficial to the efficient operation of seabasing ships with rotorcraft of other sizes and configurations, especially when the loading of wheeled or tracked vehicles is involved. FIG. 8 is a set of top-views of a seabasing ship with large JHL tandem-rotor transport helicopters on the flight deck. A ship arrangement 800 has aircraft 802 placed on a flight deck 804 and oriented inline with the ship, providing a capacity of 11 JHL-size helicopters with tandem rotors. Alternatively, an advantageous ship arrangement 810 has aircraft 812 placed on a flight deck 814 and oriented in a carousel fashion inline with the ship, providing an improved capacity of 13 JHL-size helicopters with tandem rotors. The ship has a centerline 816 and elevators 818 are laterally placed in a position between the centerline and a nearer edge 820 of the flight deck. It is contemplated that the elevators can be placed coincident with the centerline, or within 5%, 10%, 15%, 20%, or even 25% of a distance from the centerline to the nearer edge of the flight deck.

Among the benefits of the proposed design are: (a) aircraft operation is separated from vehicle or payload operation for increased safety; (b) fewer personnel are required on deck to handle loading and unloading; and (c) there is greatly reduced need for folding and repositioning of the aircraft on deck.

Such seabasing ships can be advantageously realized by modifying a commercial containership design or even converting an existing containership. It is contemplated that a modification or conversion on the basis of a containership is of considerably lower cost. Among modern commercial ship types, large containerships are especially suited for modification of an existing design to an affordable seabasing asset for large VTOL or super-short takeoff and vertical landing (SSTOVL) aircraft. It is also contemplated that an existing ship could be converted to a new role as a seabasing ship.

Especially preferred seabasing ships are based on hull, mechanical, and electrical (HM&E) systems used in large commercial containerships. This allows the seabasing ship to take advantage of the affordability and economies of scale conferred by modern commercial designs. As used herein, basing a new ship design on the design of another ship means that the new ship hull design has significant commonality with the basis hull design: at least some of the immersed outside mold line remains common, at least some of the structural girders remain common, and at least some of the original ballast compartments remain common.

Several attributes of large containerships contribute to their suitability as a basis of preferred seabasing ships.

First, large containerships already have the fuel capacity for long range travel at relatively high design speeds, typically around 25 knots (as contrasted, for example, with tanker ships, typically designed for about 15 knots).

Second, large containerships have propulsion by direct-drive low-speed diesel engines and large slow-turning propellers, giving the highest fuel efficiency of any available engine type, low fuel rates over a wide range of power and speed during the mission, and allowing ship operation with minimum practical manning.

Third, these ships have a relatively high freeboard (the distance from the waterline to the upper deck level), providing a suitable height above water for the flight deck.

Fourth, the hull proportions are intended for relatively high speed (typically 25 knots).

Fifth, the greatest extent of a large containership's upper deck area is open (or with hatch covers only), with minimum extent of superstructure. Modifying the design of such a ship, or converting such a ship requires less modification of existing structures.

Sixth, the longitudinal strength of the upper part of the hull girder is maintained by the existing "box girders," port and starboard, which are retained.

Finally, in these container ships there are multiple large, empty container holds (essentially open spaces) as well as only a minimal amount of structure requiring redesign or modification. This also allows for ease of incorporating additional internal decks and bulkheads as required by a sea basing ship.

In a preferred modified seabasing ship design, the containership's cargo deadweight (In the especially preferred embodiment, this constitutes a large fraction, about 75% or more, of the displacement) is available to support the weights of numerous important items, including: (a) the flight deck and supporting structures, (b) cargo, i.e., pre-positioned vehicles and equipment (amounting to a relatively modest fraction of the original containership's cargo deadweight), (c) cargo access arrangements (elevators, elevator trunks, and machinery), (d) aircraft and aviation support facilities, including command, control, and communication systems as required, (e) internal decks for stowage of pre-positioned cargo (vehicles and equipment); accommodations for aviation and other military detachments, and for transient (troop) personnel, (f) additional bulkheads for a higher standard of damaged stability, (g) tankage for additional (aviation and land vehicle) fuels, (h) auxiliary machinery (electrical, HVAC, water-making capacity) for a greatly increased number of personnel aboard), and (i) enhanced firefighting systems and dewatering capacity machinery.

Dimensions of existing modern containership classes vary widely. It is contemplated that many existing containership designs would be suitable for conversion to a seabasing ship. In containership services, other things being equal, economies of scale favor ships of the largest size for conversion. However, as a seabasing asset, military considerations such as operating flexibility and over-all capabilities of the seabase may be preferred in some cases. Typical large containerships in the current fleets may be broadly categorized into three size groups.

The first size category is the so-called Panamax size, a reference to the maximum ship size compatible with the Panama Canal. Such containerships often have dimensions of approximately 290 meters length over-all and a 32 meter beam (maximum width). This size of ship has an approximately 2,500 twenty-foot equivalent (TEU) container capacity, and typically features maximum a draft (the distance between the waterline and the bottom of the hull) of about 12 to 13 meters. The displacement is typically between 55,000 and 75,000 tons, depending on design speeds; the service speed is about 23 knots, being driven by a slow-speed direct connected diesel of about 53,000 horsepower connected to a single-screw.

The second containership category is that of Post-Panamax sized ships, which typically have a container capacity of about 8,000 TEU. These containerships are usually about 323 meters long over-all and have a 42 to 43 meter beam (maximum width). This would be associated with a maximum draft about 14 to 15 meters and a displacement of about 116,000 tons. Such a ship might achieve a 24-25 knot service speed with a slow-speed direct connected diesel of approximately 90,000 horsepower driving a single screw.

The third ship size category is that of very large containerships. As used herein, these ships are defined to have greater than a 10,000 TEU container capacity. Such ships may be accommodated by future expansion of the Panama Canal, and includes ships of the so-called Malacca Max size, which is the largest size of ship capable of fitting through Strait of Malacca, or larger-yet containerships. An example of this class of containership in the prior art is the Maersk™ Emma Maersk. It is contemplated that ships from this size class are especially suitable for conversion to a seabasing ship. While this category of ship includes a variety of sizes, a notional very large containership similar to the Maersk™ Emma Maersk would have a length of 365 to 400 meters and a beam of 52 meters or wider. The cargo capacity would be 11,000 to 18,000 TEU, with a Scantling draft of about 17 meters, and a displacement of around 200,000 tons. Such ships are typically powered by a single-screw direct coupled diesel of approximately 110,000 horsepower installed power, and achieve a 24 to 25 knot service speed.

Figure 9:
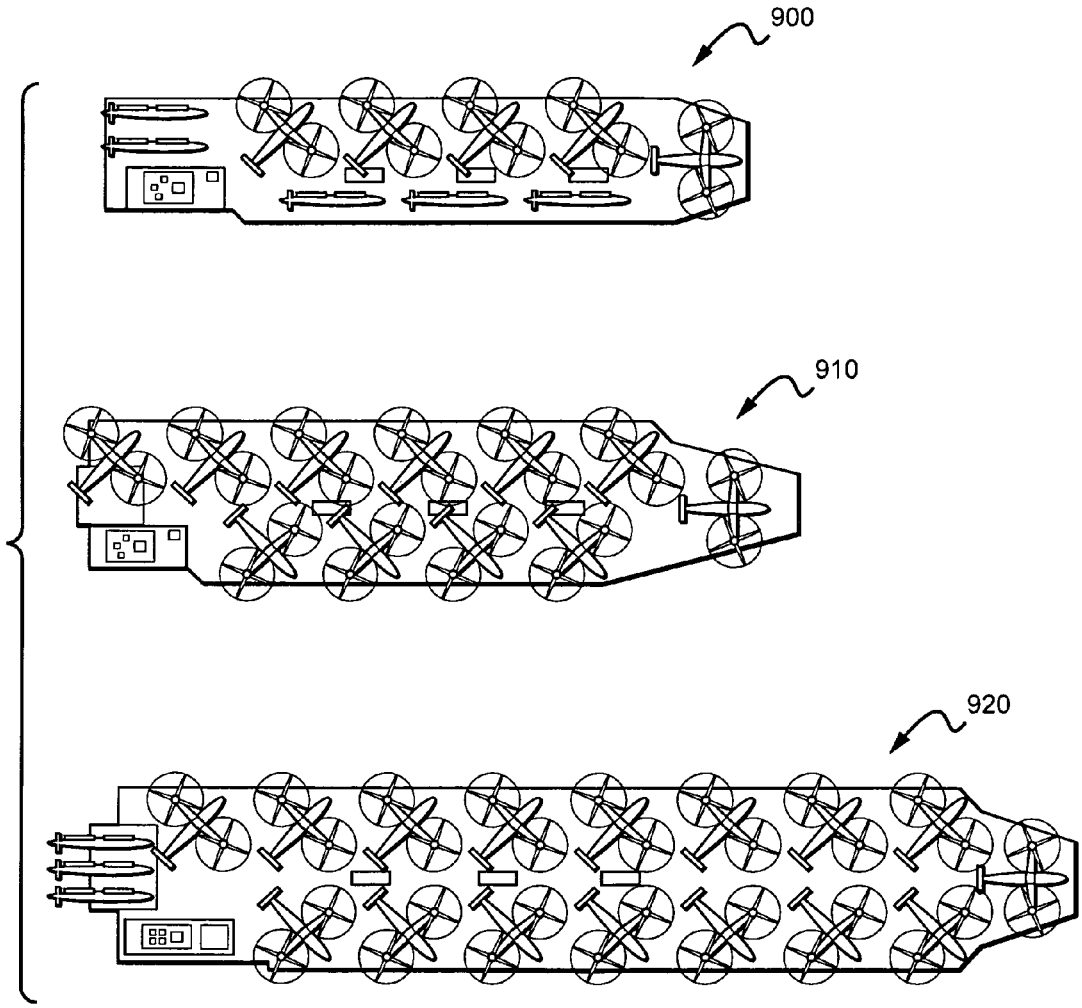
FIG. 9 is a set of top views of preferred embodiment seabasing ships built on the basis of Panamax, Post-Panamax and very large containership sizes.

FIG. 9 shows preferred embodiment seabasing ships based on three basis containership size classes, the Panamax size 900, the post-Panamax size 910, and the very large containership size 920. In converting a containership to a seabasing ship, preferred flight decks have a breadth of at least the ship beam, and especially preferred flight decks overhang on either side of the original containership beam. Thus, a conversion of a very large containership with a 52 meter beam would have a flight deck breadth of at least 170 feet, and could easily accommodate a flight deck having a breadth of 180, 200, 220, 240, or even 260 feet. The speed of a ship is largely dependent on three parameters: the displacement, the hull form, and the power of the propulsions system. Preferred seabasing ships have a hull form and installed power to accommodate cruising at sustained speed of 20, 22, 25, 27, 29 or even 31 knots. The term "maximum speed" is defined as the ship's speed in calm water with all engines at maximum continuous rating. The term "sustained speed" is defined as the ship's speed in calm water with a clean bottom and all engines at 80% of the maximum continuous rating. Typically, a ship cruises at a sustained speed where possible for fuel economy, but is capable of cruising at maximum speed when needed.

Figure 10:
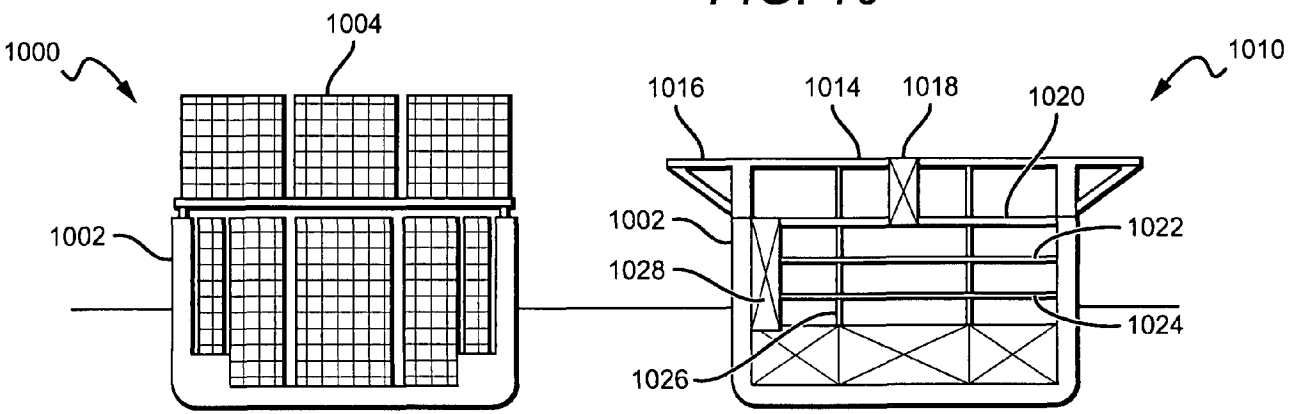
FIG. 10 is a set of cross-sections illustrating the conversion of a containership 1000 into a seabasing ship 1010.

Depending on the specific containership design used as a basis, the new flight deck would preferably be erected in the form of a superstructure deck, supported either directly on the existing box girders, or on "bents" (large transverse frames) tied into the box girders. FIG. 10 is a typical central cross-sectional view of a pre-conversion containership 1000 and a preferred post-conversion seabasing ship 1010. The hull structure before conversion 1002 and after conversion 1012 remain the same up to the main deck structure and box girders. Shipping container 1004 provisions including cell guides can be removed. A flight deck 1014 with sponsons 1016 is added, along with central payload elevators 1018 for transporting vehicles, including armored vehicles, or other equipment, to and from the flight deck. A payload staging deck 1020 is added below the flight deck with high overhead clearance that can function as a vehicle preparation and loading area, an area that stores armored vehicles, or as a stowage area for overheight vehicles or double-stacked containers. As used herein, the term "payload staging deck" means a deck area below the flight deck with sufficient overhead clearance for vehicle storage and repositioning.

Preferred seabasing ships would have additional internal decks 1022, 1024 for cargo, vehicle, or equipment stowage and accommodations that would be added below the flight deck and payload staging area, and above additional fuel and ballast tankage. Transverse bulkheads 1026 are added as required for damaged stability and cargo segregation.

Vehicle elevators 1018 from each hold, serving the flight deck 1014, would preferably be installed on or near the ship's centerline. This location would permit longitudinal vehicle movements on the flight deck to be kept as clear as possible of aircraft spots, while still permitting uninterrupted flow of vehicles to the tail ramps of their assigned aircraft. The inboard location also keeps the main flow of vehicle traffic away from the deck edges.

It is contemplated that vehicle elevators 1018 could be arranged to serve the flight deck either directly from the any of the below decks 1020, 1022, 1024. Or, more preferably, one set of elevators 1018 could transfer cargo between the flight deck and the payload staging deck, while other sets of elevators 1028 could transfer armor and cargo between vehicle holds and the payload staging deck 1020. The latter arrangement would permit additional flexibility in selective breakout of vehicles, shorter elevator movements and reduced delay times during aircraft loading, and in some cases reductions in vehicle movements on the flight deck. The elevators 1018, 1028 preferably have a capacity for armored vehicles weighing at least 20,000 pounds, 40,000 pounds, 60,000 pounds, 80,000 pounds, 100,000 pounds, or even 120,000 pounds.

Figure 11:
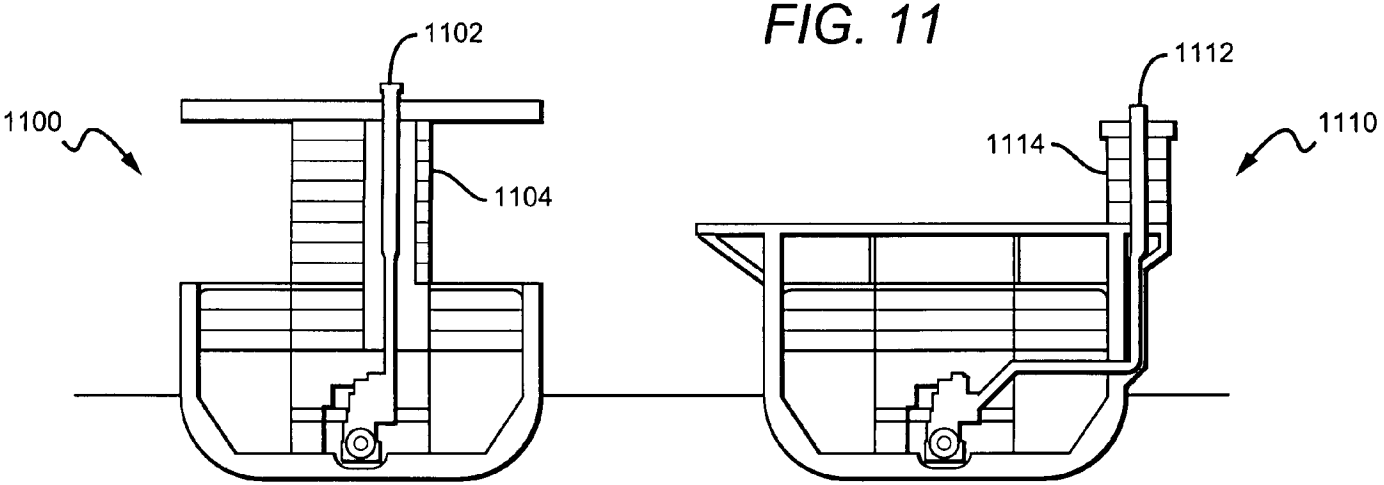
FIG. 11 is a set of propulsion-machinery space cross-sections illustrating the conversion of a containership 1100 into a seabasing ship 1110.

It is further envisioned that the existing ship propulsion machinery could be retained. FIG. 11 is a typical propulsion-machinery space cross-sectional view of a pre-conversion containership 1100 and a preferred post-conversion seabasing ship 1110. The containership intake and exhaust trunks 1102 would be preferably relocated to a new trunk location 1112 in order to provide a continuous uninterrupted length of flight deck. Additionally, the containership superstructure 1104 would be removed, and a new superstructure 1114 would be added on the side of the ship. New auxiliary machinery spaces would be located in spaces formed out of existing container cargo holds, with intakes and uptakes through the sides of the ship. Roll stabilization systems (generally with active fins) are incorporated in many recent prior art large containership designs, but could be added to a design if not already present in the basis ship or design.

The security and survivability of the seabasing ship may benefit from the incorporation of an auxiliary propulsion system, supplementing the single-screw propulsion system that has become almost universal in modern commercial containerships. It is contemplated that, for maximum separation and survivability, an auxiliary propulsion system using multiple commercial retractable propulsion units could be distributed with at least some of the units located well forward.

The preferred acquisition strategy for a seabasing ship based on a modified commercial containership design is essentially a programmatic and policy issue. In principle, however, unless policy-driven considerations prevented it, the basic HM&E platform could be built in an overseas yard, followed by completion of command, control, communications, computers, intelligence, surveillance and reconnaissance (C4ISR) facilities and other mission-related equipment in a domestic shipyard.

Figure 12:
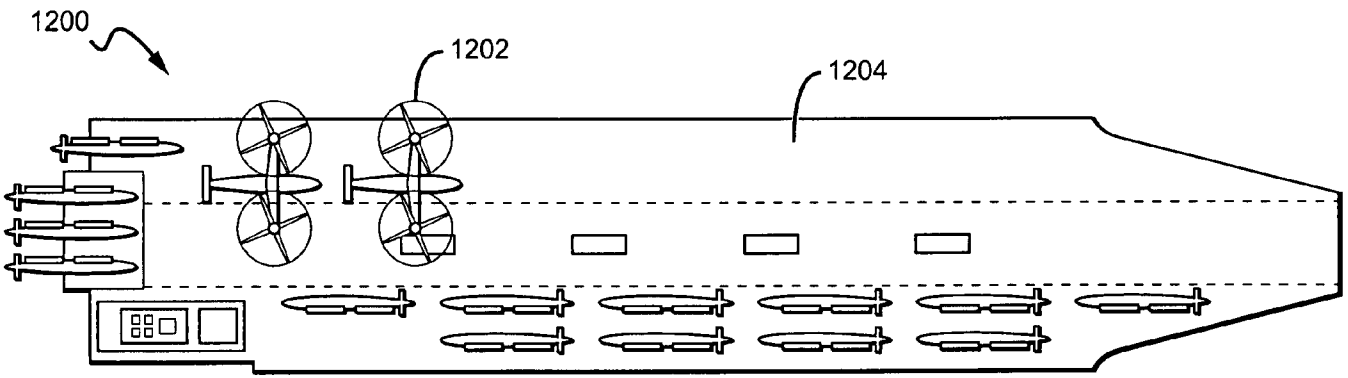
FIG. 12 is a top view of a seabasing ship with the aircraft on the flight deck re-arranged for STOL operations.

From an operational perspective, aircraft can be too heavy to launch vertically, but may still be capable of a short takeoff and landing (STOL). FIG. 12 shows a preferred seabasing ship 1200 with the aircraft 1202 on the deck re-arranged to allow for STOL operations over a free portion of the flight deck 1204 as shown in FIG. 12.

Figure 13:
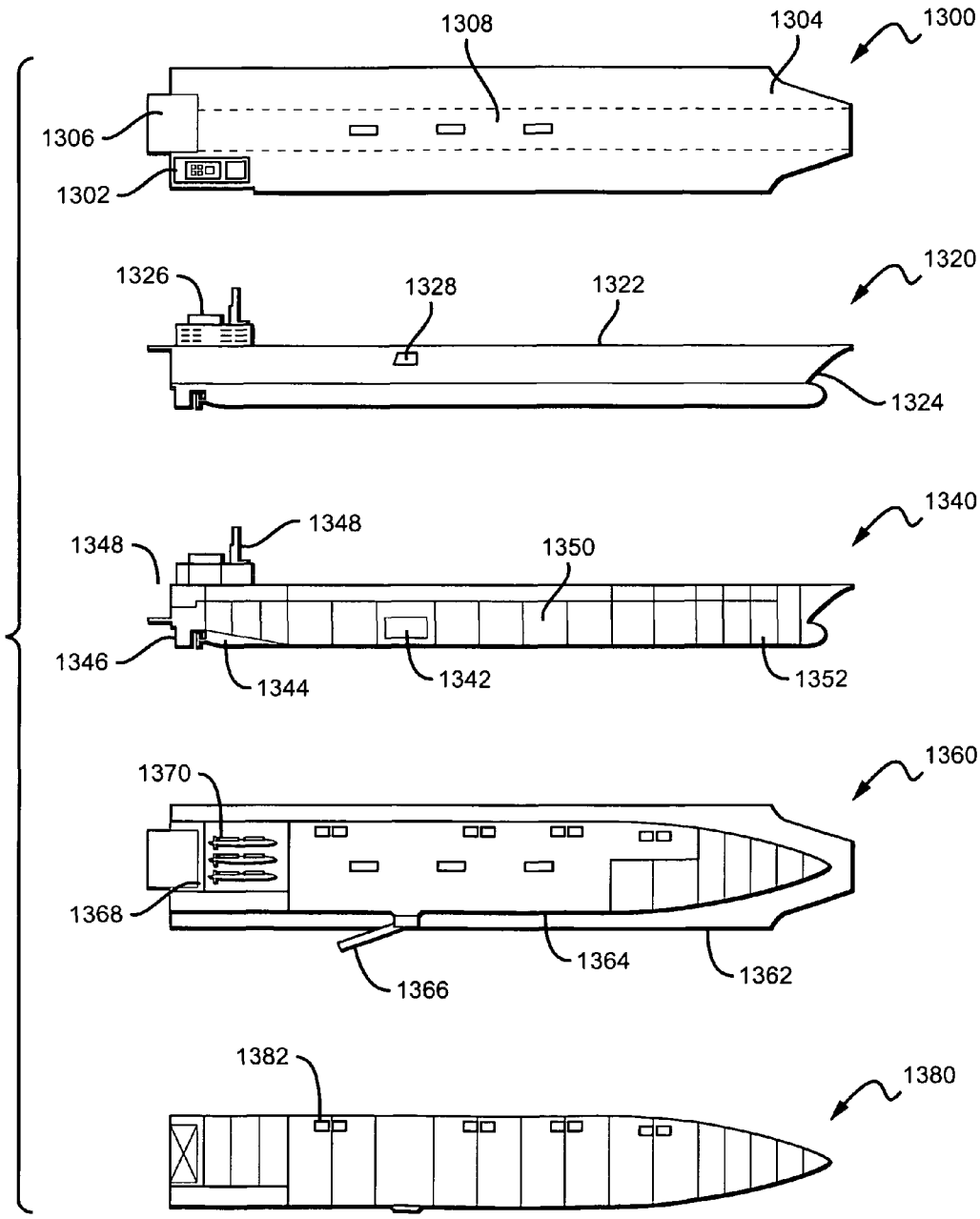
FIG. 13 is a set of top, side, and deck plan views of a ship showing detail on a preferred seabasing shape on the basis of a very large containership.

FIG. 13 shows additional detail on a preferred seabasing ship arrangement on the basis of a very large containership with a series of top 1300, side 1320, and cutaway 1340, 1360, 1380 views of a ship. A superstructure 1302 extends upwards from the flight deck providing a location for command and control operations. The flight deck 1300 is a large open area suitable for the takeoff, landing, and storage of one or more aircraft; the flight deck 1300 is preferably flat, but some contemplated flight decks may have a sloped ski jump area. An aircraft elevator 1306 allows aircraft to be moved from the flight deck to a below-deck hangar area. A vehicle transit lane area 1308 is marked on the flight deck, indicating the preferred area for vehicle and payload movement, including aircraft loading operations. A side view 1320 of the same ship shows flight deck 1322 on top of the ship and a hull 1324 with keel and bow portions. Propulsion system exhaust provisions 1326 are located above the flight deck near the stern. A door 1328 for loading and unloading armored vehicles is in the side of the ship. A side cutaway 1340 of the same ship shows an area for propulsion machinery and an engine 1342 that connects to a screw 1344 operating in front of a means for directional control 1346, and located below the waterline 1348. Additionally, the ship provides areas for tankage 1350, which can include fuel for the ship, fuel for ground vehicles, and fuel for aircraft in separate divisions. Separate ballast areas 1352 are provided towards the bottom of the ship. A top cutaway 1360 of the same ship shows that the flight deck 1362 extends substantially wider than the beam of the containership basis hull 1364. It is contemplated that the flight deck can be 5%, 10%, 15%, 20%, or even 25% wider than the containership basis hull, and that the flight deck can extend along 20%, 40%, 60%, 80%, or even 100% of the ship's maximum length. An optionally retractable ramp 1366 allows vehicles to drive onto the ship and directly into the payload staging area. A hangar area 1362 below the flight deck allows for the storage, maintenance, and repair of aircraft 1364, which are preferably foldable for compactness. A final top cutaway 1380 of the ship reveals interior elevators suitable for transporting vehicles, including armored vehicles, and other equipment between internal decks.

While the description above places emphasis on the conversion of containerships into seabasing ships, it is contemplated that the inventive aspects described could be implemented on any suitable ship, including for example a conversion of a cruise liner, conversion of a tanker ship, or a purpose-built seabasing ship or aircraft carrier.

Thus, specific embodiments and applications of a novel seabasing ship have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of utilizing aircraft with respect to a ship having a hull form and installed power that allows the ship to cruise with a speed of at least 20 knots, the ship further having a port and starboard sides, a flight deck, and a payload staging deck under the flight deck, comprising positioning first and second ones of the aircraft on the flight deck and ready for take-off, on the port side of the ship;

positioning third and fourth ones of the aircraft on the flight deck and ready for take-off, on the starboard side of the ship; and wherein each of the first, second, third and fourth ones of the aircraft have an orientation angle between 20° and 180° from dead ahead.

2. The method of claim 1, further comprising positioning at least some of the aircraft about an elevator in a carousel fashion.

3. The method of claim 1, further comprising raising a payload for at least one of the aircraft to the flight deck using an elevator located central relative to the flight deck.

4. The method of claim 3, wherein the flight deck has a centerline, and the elevator is located within 20% of a distance from the centerline to a nearest edge of the flight deck.

5. The method of claim 1, further comprising positioning at least five other ones of the aircraft on the flight deck and ready for take-off, on the port side of the ship.

6. The method of claim 1, further comprising positioning at least ten other ones of the aircraft on the flight deck and ready for take-off, split between the port and starboard sides of the ship.

7. The method of claim 1, wherein the first, second, third and fourth ones of the aircraft are vertical take-off and landing (VTOL) aircraft.

8. The method of claim 1, wherein the first, second, third and fourth ones of the aircraft are capable of carrying a payload greater than 20,000 pounds.

9. The method of claim 1, wherein the ship has a design based on a containership design.

* * * * *